US010710792B1

(12) United States Patent
Lollar

(10) Patent No.: US 10,710,792 B1
(45) Date of Patent: Jul. 14, 2020

(54) AEROSOL CONTAINER WITH EASY-TO-OPERATE PUSH BUTTON

(71) Applicant: Phyllis Lollar, Danville, IL (US)

(72) Inventor: Phyllis Lollar, Danville, IL (US)

( * ) Notice: Subject to any disclaimer, the term of this patent is extended or adjusted under 35 U.S.C. 154(b) by 0 days.

(21) Appl. No.: 16/239,688

(22) Filed: Jan. 4, 2019

(51) Int. Cl.

| | |
|---|---|
| ***B65D 83/16*** | (2006.01) |
| ***B65D 83/20*** | (2006.01) |
| ***B65D 83/14*** | (2006.01) |
| ***B65D 83/32*** | (2006.01) |
| ***B65D 83/38*** | (2006.01) |
| *B65D 83/28* | (2006.01) |
| *B65D 83/40* | (2006.01) |

(52) U.S. Cl.
CPC ..... *B65D 83/205* (2013.01); *B65D 83/32* (2013.01); *B65D 83/38* (2013.01); *B65D 83/75* (2013.01); *B65D 83/28* (2013.01); *B65D 83/40* (2013.01)

(58) Field of Classification Search
CPC ..... B65D 83/32; B65D 83/38; B65D 83/205; B65D 83/28; B65D 83/40; B65D 83/75
See application file for complete search history.

(56) References Cited

U.S. PATENT DOCUMENTS

| | | | | |
|---|---|---|---|---|
| 2,090,334 A * | 8/1937 | Paasche | B65D 83/207 239/337 |
| 2,790,190 A * | 4/1957 | Mastrandrea | A46B 11/0017 401/46 |
| 3,282,510 A * | 11/1966 | Van Schwartz | B05B 9/0805 239/373 |
| 4,239,407 A * | 12/1980 | Knight | B65D 83/20 222/394 |
| 7,757,906 B2 | 7/2010 | Barry | |
| 9,889,982 B2 | 2/2018 | Falcon et al. | |

* cited by examiner

*Primary Examiner* — J C Jacyna
(74) *Attorney, Agent, or Firm* — Sanchelima & Associates, P.A.; Christian Sanchelima; Jesus Sanchelima

(57) ABSTRACT

The present invention is an aerosol container with an easy-to-operate push button which requires minimal strength to operate push button and hence operable by children and people having less strength. Aerosol container includes a main body, a nozzle, a pipe and an actuating mechanism. Actuating mechanism includes a valve operable by a push button and a release spring. Valve is in connection with an internal body portion of pipe and selectively permits flow of aerosol from main body to nozzle upon actuation of push button disposed in-line with valve, transverse to pipe and externally of main body. As push button is disposed centrally of main body, children or people with less strength or suffering from illness like Parkinson are easily able to push the push button.

5 Claims, 4 Drawing Sheets

AEROSOL CONTAINER WITH EASY-TO-OPERATE PUSH BUTTON

BACKGROUND OF THE INVENTION

1. Field of the Invention

The present disclosure relates to an aerosol container. More particularly, the present disclosure relates to an aerosol container provided with an easy-to-operate push button.

2. Description of the Related Art

People suffering from various diseases, such as Parkinson, or children find difficulty in operating push button of an aerosol container because of lack of sufficient strength. Hence, there is a need for an aerosol container that has an easy-to-operate push button.

Several designs for various aerosol containers have been designed in the past. None of them, however, includes an aerosol container with an easy-to-operate push button that requires minimal strength to operate and hence operable by children and people suffering from various diseases and have less physical strength.

Applicant believes that a related reference corresponds to a U.S. Pat. No. 9,889,982 filed by Silgan Dispensing Systems Inc for aerosol actuators, devices, and methods of making and using the same. The Silgan Dispensing System Inc reference discloses an aerosol actuator that includes a "toggle" feature allowing an aerosol product to be actuated by pressing the toggle actuator from any direction. However, presence of toggle feature makes the mechanism of actuator complex.

Another related application is U.S. Pat. No. 7,757,906 by Barry Michael for an air movement indicating device. The patent application '906 discloses an air movement indicating device with a trigger attached to cap. Trigger includes a handle portion and a nozzle actuation portion attached to handle portion. However, the handle portion extends from the cap in which nozzle actuation portion is provided thus rendering the trigger mechanism complex.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an aerosol container with an easy-to-operate push button introduced through longitudinal face of a main body of aerosol container and that requires minimal strength to operate push button and hence operable by children and people having less strength.

It is an object of the present invention to provide an aerosol container that includes push button disposed at a substantially central portion of aerosol container and hence is easy to operate by a user.

It is yet another object of the present invention to provide an aerosol container that has a simple mechanism.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
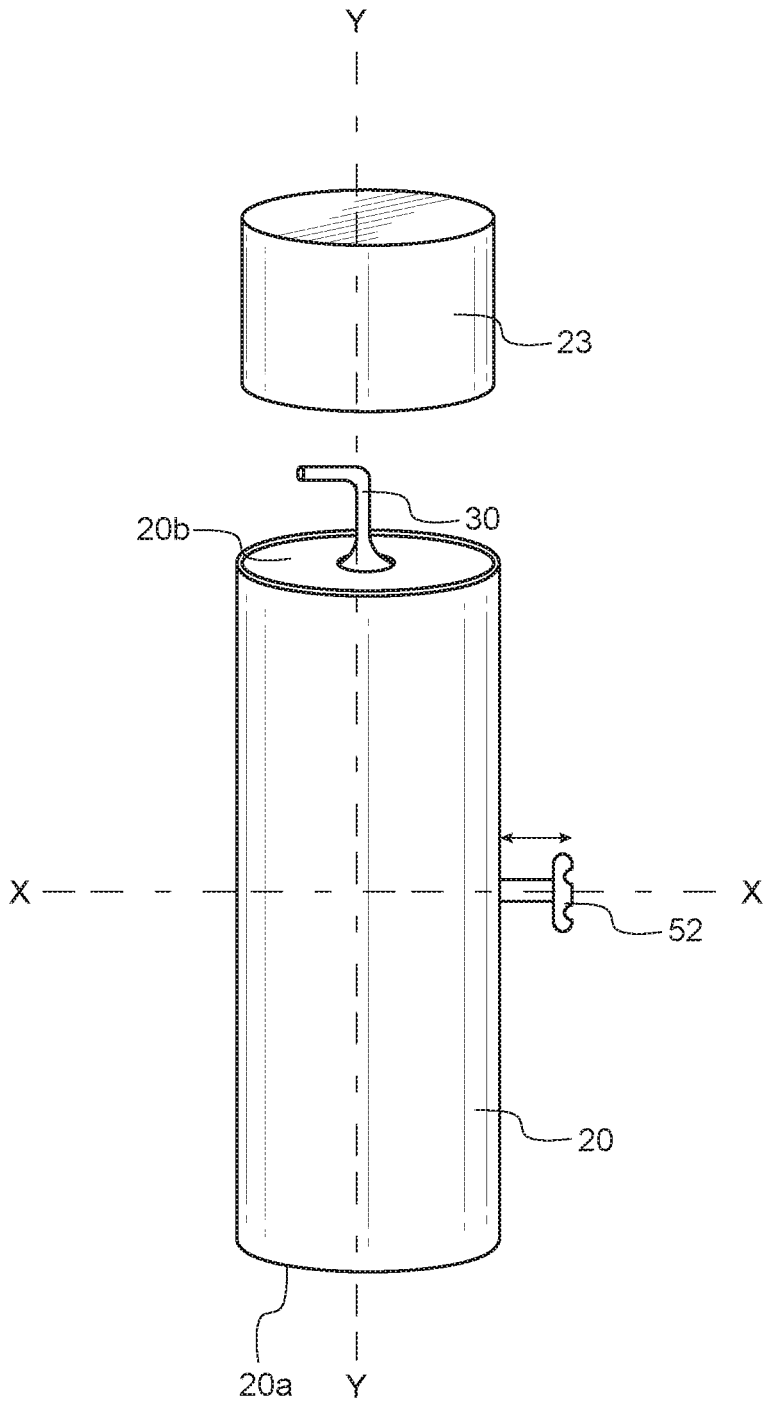
FIG. 1 represents a perspective view of an aerosol container 10 with a push button 52 disposed substantially centrally of a main body 20 of aerosol container 10, wherein push button 52 is in an inoperative release configuration.

Referring now to the drawings, FIGS. 1-4, where the present invention is generally referred to with numeral 10, it can be observed that an aerosol container, in accordance with one embodiment, is provided that mainly includes a main body 20, a nozzle 30, a pipe 40 and an actuating mechanism 50.

Main body 20 is an enclosed container and stands on a base 20*a* and an opening (not illustrated in Figures) provided at a top end 20*b* end. Main body 20 contains aerosol substance 21 in liquid form. Main body 20 can be made of polymeric material or metal or can be made of any other material or combination of materials.

Nozzle 30 is connected at opening provided at top end 20*b* to allow formation of a jet of aerosol mist 22 from aerosol substance 21 because of small-sized diameter. Nozzle 30 directs aerosol substance to move out of main body 20. In one embodiment, nozzle 30 is enclosed by a cap 23 that is selectively in connection with main body 20. Nozzle 30 is adjustable by rotating so that user can spray aerosol mist 22 at desired location without much twisting of hand.

Pipe 40 is defined with a first end 40*a*, a second end 40*b* and a body 40*c* disposed between first end 40*a* and second end 40*b*. First end 40*a* is introduced in aerosol substance 21 contained within main body 10. Second end 40*b* is connected to nozzle 30. In operative configuration, aerosol substance 21 is passed through pipe 40.

Figure 2:
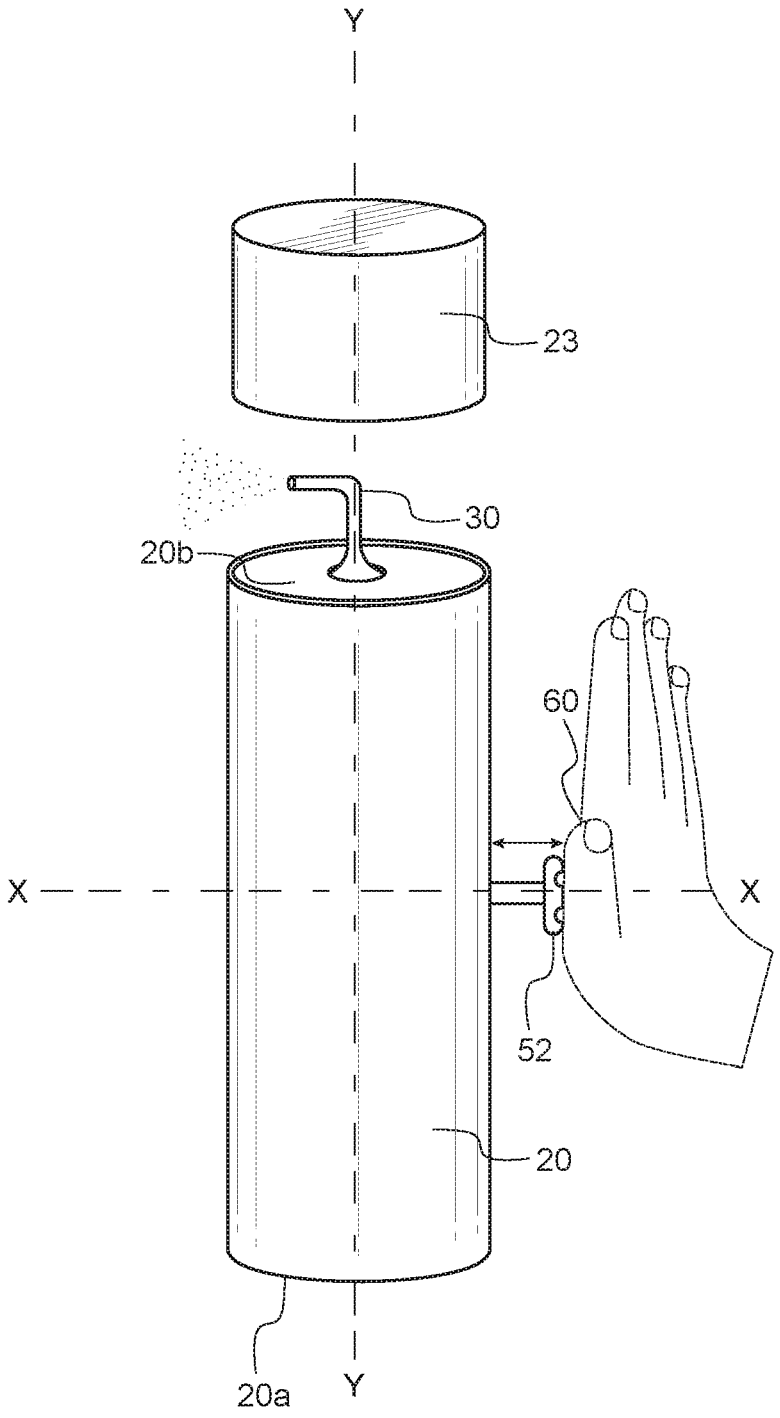
FIG. 2 represents a perspective view of aerosol container 10 with push button 52 in an operative pressed configuration and allows flow of aerosol substance 21 out of nozzle 30 in form of aerosol mist 22.
Figure 3:
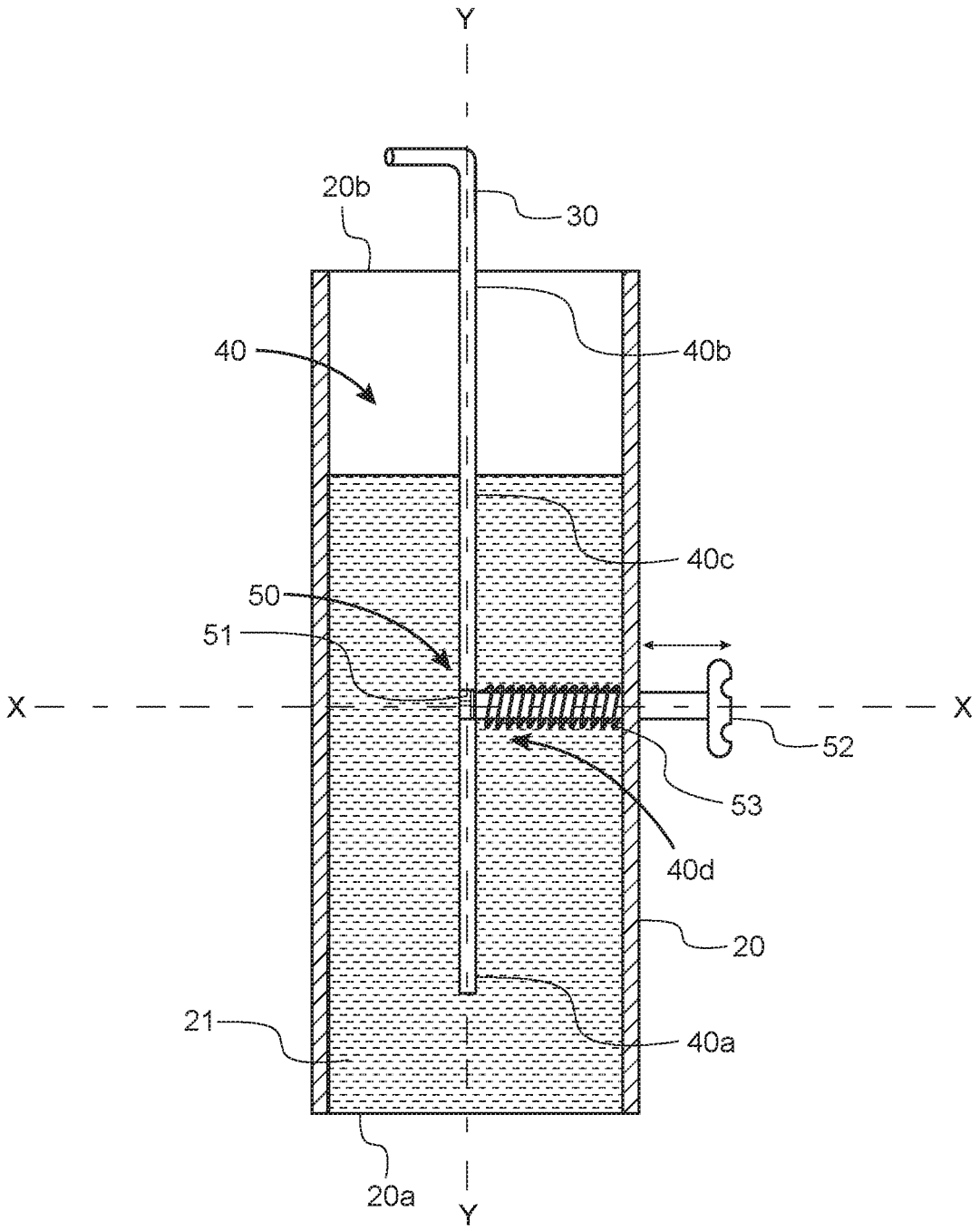
FIG. 3 represents an internal view of aerosol container 10 with push button 52 disposed substantially centrally of a main body 20 of aerosol container 10, wherein push button 52 is in an inoperative released configuration.
Figure 4:
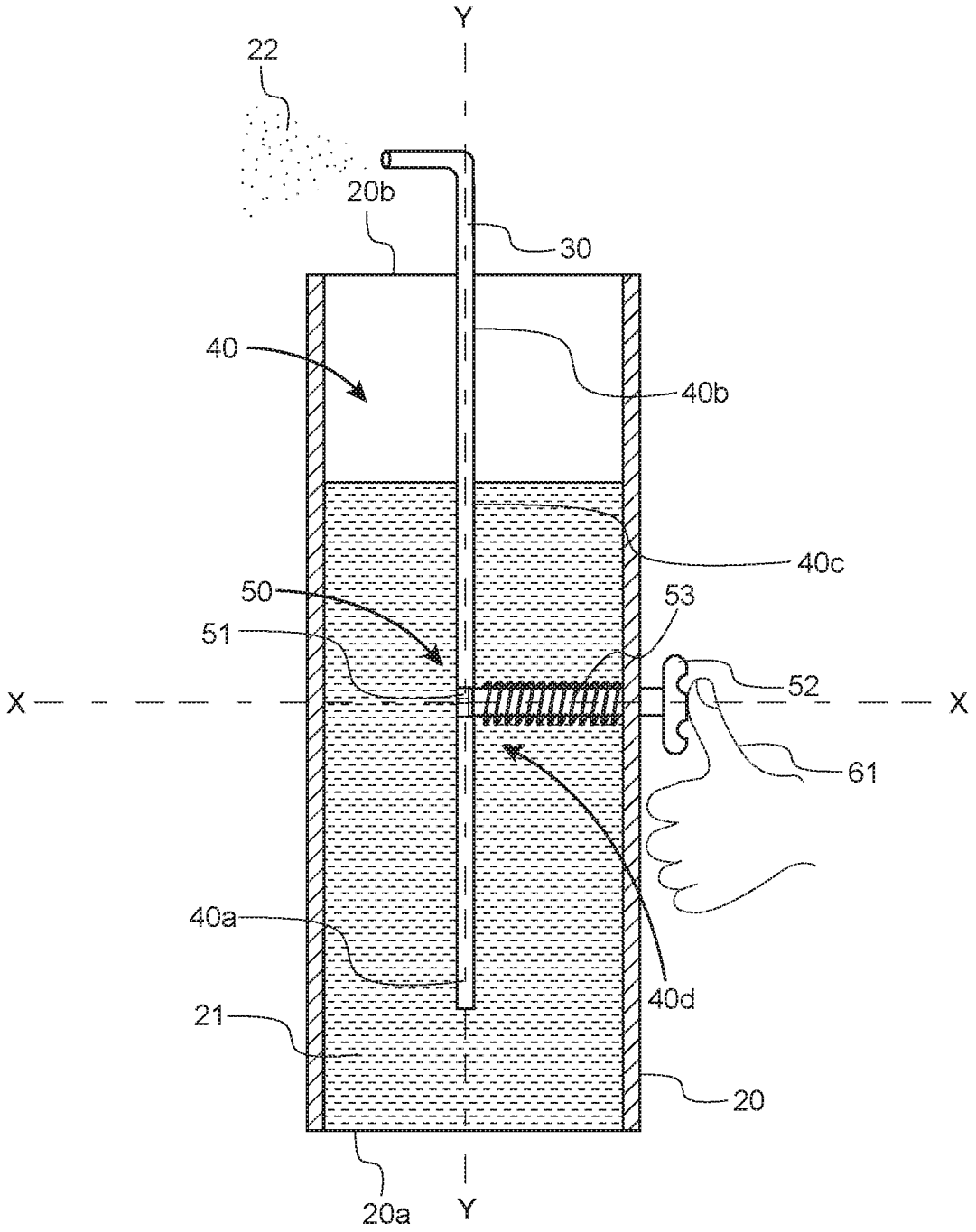
FIG. 4 represents an internal view of aerosol container 10 with push button 52 in an operative pressed configuration and allows flow of aerosol substance 21 out of nozzle 30 in form of aerosol mist 22.

Actuating mechanism 50 in operative configuration permits flow of aerosol substance 21 from the main body 10 to atmosphere or on any object or surface. Actuating mechanism includes a valve 51, a push button 52 and a release spring 53. Valve 51 is in connection with a body portion 40*d* of body 40*c* of pipe 40. More specifically, valve 51 allows and restricts flow of aerosol substance 21 through pipe 40. Valve 51 is actuated by push button 52 through a rod 54. Release spring 53 is disposed on rod 54. Push button 52 is in-line with valve 51 such that axis 'X-X' of push button 52 is transverse to axis 'Y-Y' of pipe 40 and push button 52 is outside main body 20. Valve 51 is positioned on pipe 40 such that push button 52 is disposed centrally of main body 20. Push button 52 is operated by either by a palm 60 (as illustrated in FIG. 2) of a user or by a thumb 61 of a user (as illustrated in FIG. 4).

In operation, user pushes the push button 52 by palm 60 or thumb 61 disposed on side of main body 20. Pushing of push button 52 compresses release spring 53 and actuates valve 51 to permit flow of aerosol substance 21 converted into aerosol mist 22 from main body 20 to environment, surface or object through assembly of pipe 40 and nozzle 30. Thus, when push button 52 is pressed, an operative pressed configuration is achieved. Upon release of push button 52, release spring 53 releases push button 52 to achieve original or un-pressed configuration i.e. an inoperative release configuration of push button 52. Upon release of push button 52, valve 51 restricts flow of aerosol substance 21 through pipe 40 towards to nozzle 30.

The advantage of providing push button 52 at substantially central portion of main body 20 is that fewer efforts and strength will be required to push and operate push button 52. Thus, children or physically weak people like people suffering from Parkinson disease or like other diseases that cause weakness in hands can easily operate push button 52 disposed centrally of main body 20. Also, no other additional components or elongated handles are required to operate push button 52 and hence makes mechanism simple.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An aerosol container comprising:

a main body filled with aerosol substance, wherein said main body is cylindrical in shape and includes a bottom end being entirely flat;

a nozzle disposed on a top end of said main body, wherein said nozzle includes a vertical portion and a horizontal portion, wherein said nozzle extends within said main body a predetermined depth and lies above said bottom end of said main body, wherein said horizontal portion is located at said top end of said vertical portion, wherein said top end of said vertical portion extends outwardly from said top end of said main body, wherein said horizontal portion forms a right angle with said vertical portion;

a pipe defined with a first end introduced in aerosol substance, a second end connected to said nozzle and a body therebetween; and an actuating mechanism including a valve in connection with an internal body portion of said pipe, wherein said valve is actuated by a push button located on an outer surface of said main body, a rod mounted in a horizontal configuration connecting said push button and said valve, wherein said rod includes a spring mounted to an outer surface of said rod, wherein said rod and said spring are located entirely within said main body.

2. The aerosol container as claimed in claim 1, wherein said valve is positioned such that said push button is disposed centrally of said main body.

3. The aerosol container as claimed in claim 1, further comprises a cap for selectively enclosing said nozzle.

4. The aerosol container as claimed in claim 1, wherein said push button operable by a thumb or a palm of a user.

5. The aerosol container as claimed in claim 1, wherein said nozzle is rotatably adjustable.

* * * * *